US006293452B1

(12) United States Patent
Mandar

(10) Patent No.: US 6,293,452 B1
(45) **Date of Patent: *Sep. 25, 2001**

(54) TAPE DISPENSING BOX HOLDING PAPER SHEETS

(76) Inventor: Martine Mandar, 54, rue Moxouris, F-78150 Le Chesnay (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/888,233

(22) Filed: Jul. 3, 1997

(30) Foreign Application Priority Data

Jul. 5, 1996 (FR) ..... 96 08427

(51) Int. Cl.[7] ..... B65H 35/06
(52) U.S. Cl. ..... 225/39; 225/41; 225/42
(58) Field of Search ..... 225/39, 41, 42

(56) References Cited

U.S. PATENT DOCUMENTS

| | | | | |
|---|---|---|---|---|
| 876,866 | * | 1/1908 | Downing et al. | 225/41 |
| 2,622,815 | * | 12/1952 | Waterman | 225/41 |
| 2,924,365 | | 2/1960 | Dahlquist . | |
| 3,069,055 | * | 12/1962 | Steele et al. | 225/41 |
| 3,086,309 | | 4/1963 | Katz . | |
| 3,403,869 | | 10/1968 | Marchisen et al. . | |
| 3,760,998 | | 9/1973 | Sakihara . | |
| 3,768,713 | | 10/1973 | Lash . | |
| 4,204,618 | * | 5/1980 | Reed et al. | 225/41 |
| 4,316,563 | * | 2/1982 | Turner et al. | 225/41 |
| 4,570,837 | * | 2/1986 | Belokin | 225/42 |
| 4,676,446 | | 6/1987 | Ciocarelli et al. . | |
| 4,729,518 | | 3/1988 | Mathna et al. . | |
| 4,884,734 | * | 12/1989 | Kahl, Jr. et al. | 225/42 |
| 4,898,312 | | 2/1990 | Hwang . | |
| 5,083,717 | * | 1/1992 | Samuelson et al. | 225/42 |
| 5,221,033 | * | 6/1993 | Klein et al. | 225/39 |

* cited by examiner

*Primary Examiner*—M. Rachuba
(74) *Attorney, Agent, or Firm*—Dennison, Scheiner, Schultz & Wakeman

(57) ABSTRACT

A tape dispensing box having a parallelepipedic form including first and second main faces, an output slot for the tape with a tape cutter, a removable holding device with a support for a reel of tape and a sheet of paper having information thereon held between a main face and the holding device when the holding device is inserted into the box.

16 Claims, 8 Drawing Sheets

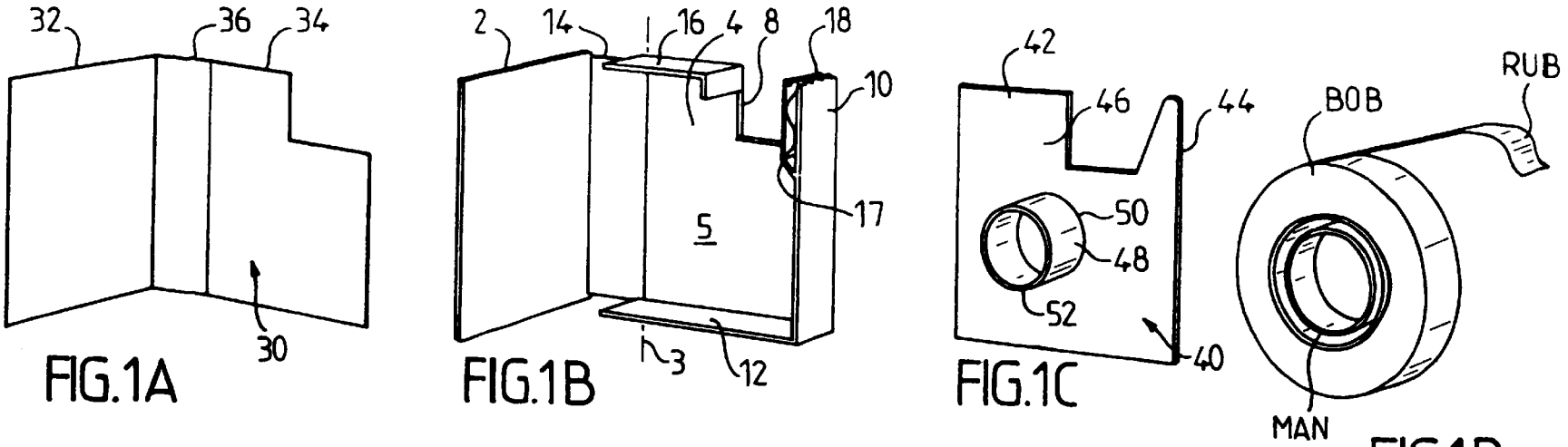
FIG.1A
FIG.1B
FIG.1C
FIG.1D
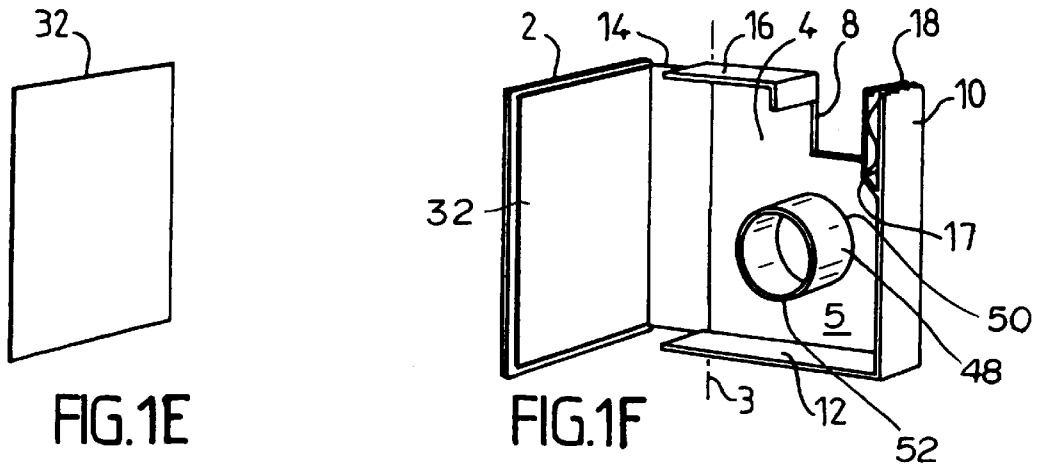
FIG.1E
FIG.1F

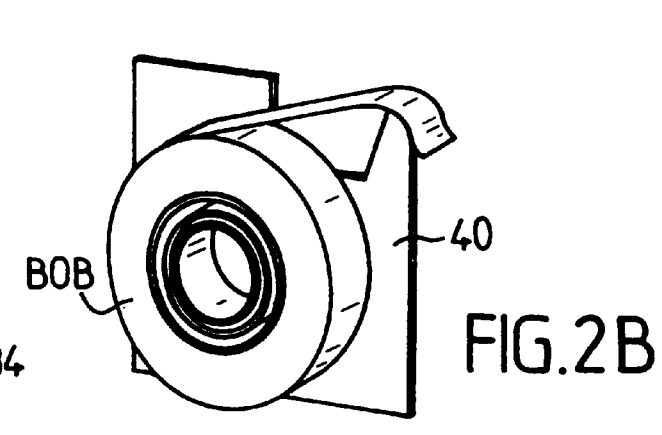
FIG.2A
FIG.2B
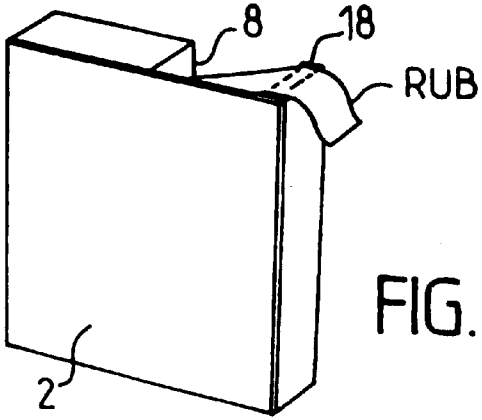
FIG.3B
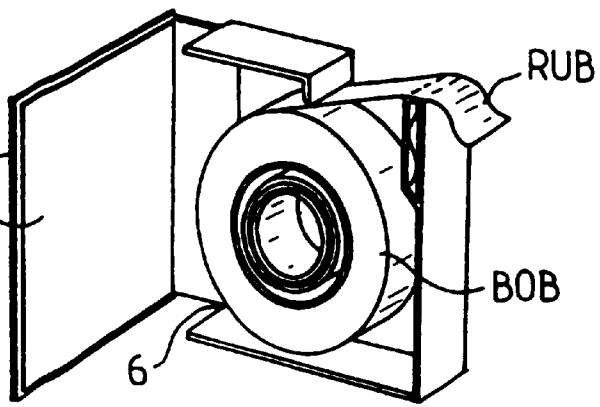
FIG.3A

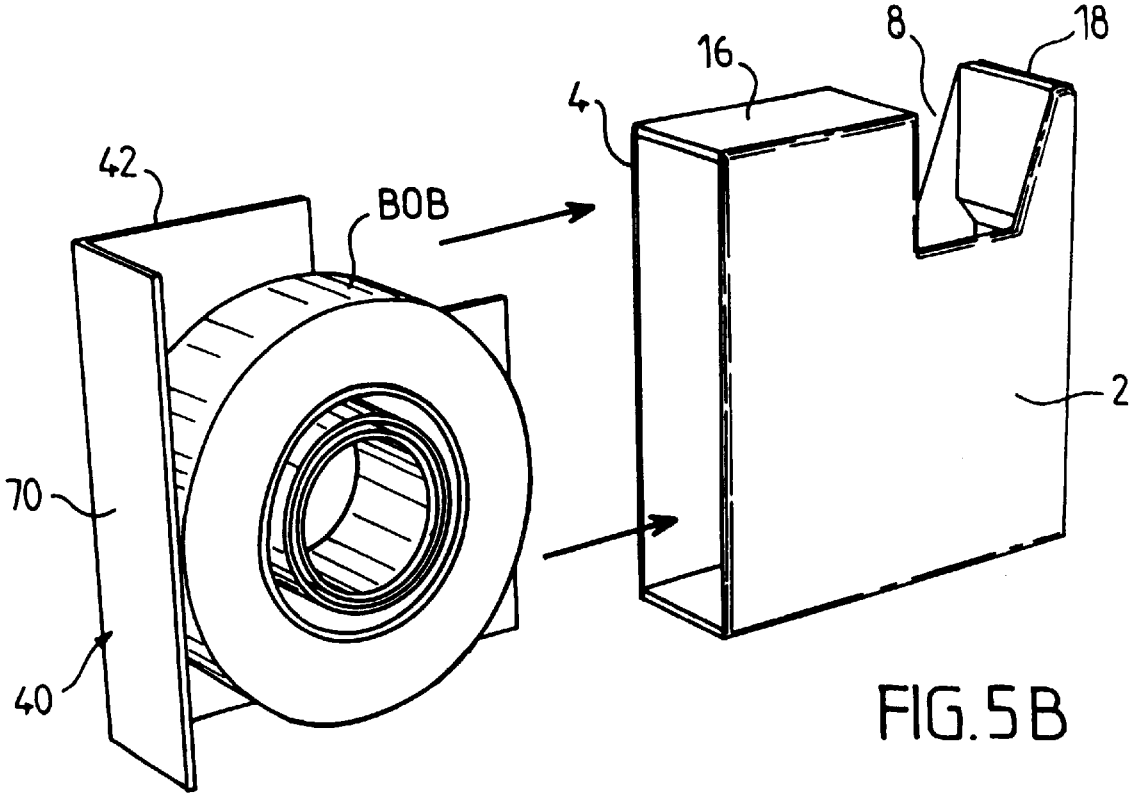
FIG.5B
FIG.5A
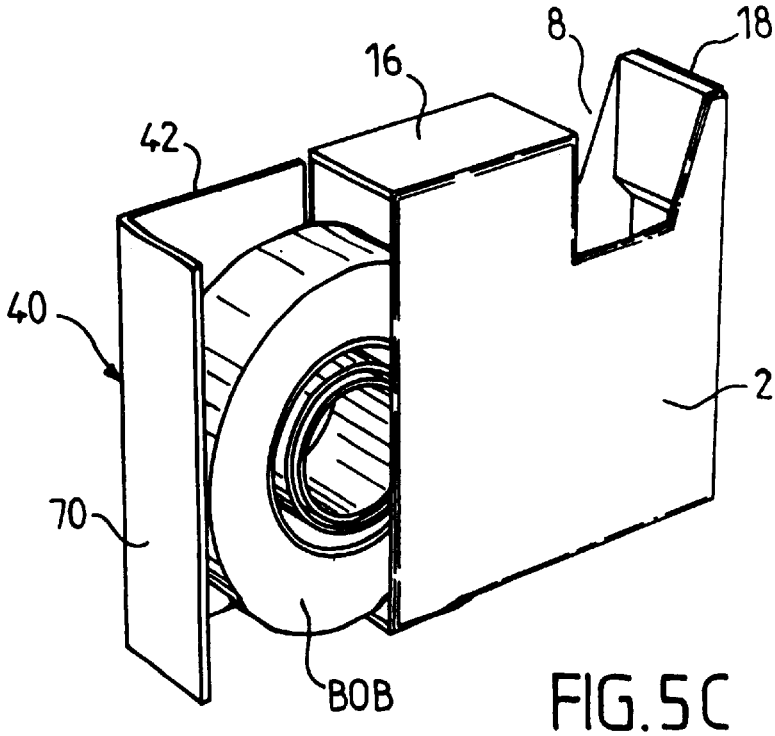
FIG.5C

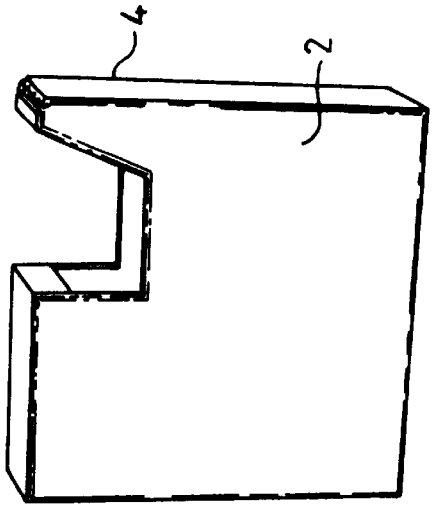
FIG.8C1
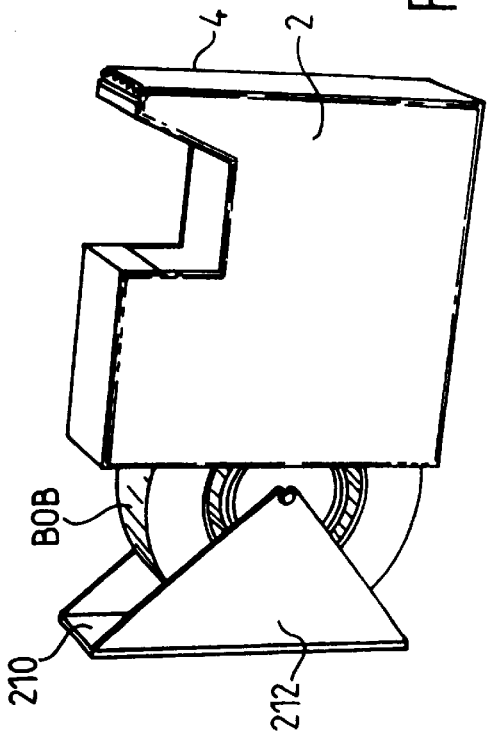
FIG.8C2
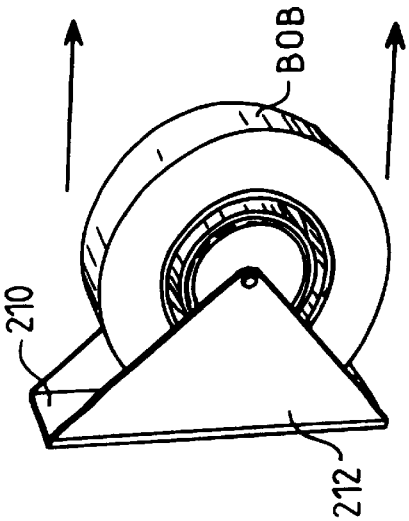
FIG.8B1
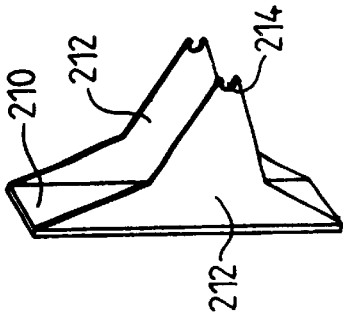
FIG.8B2
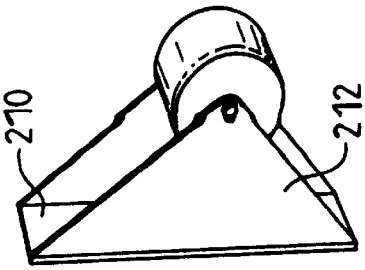
FIG.8A1
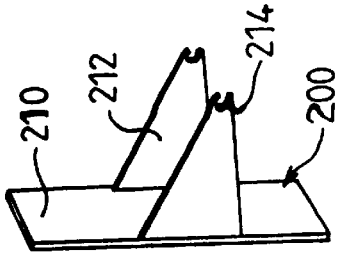
FIG.8A2

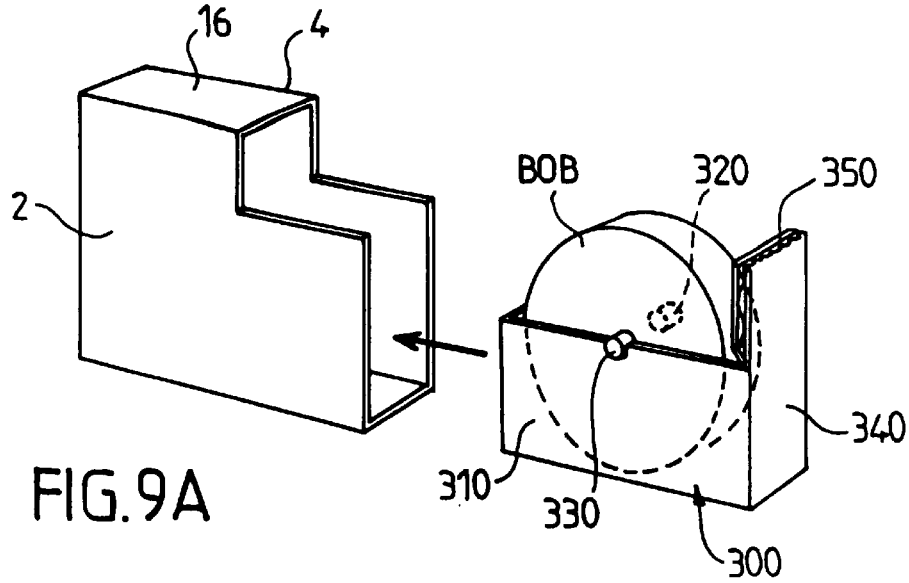
FIG.9A
FIG.9B
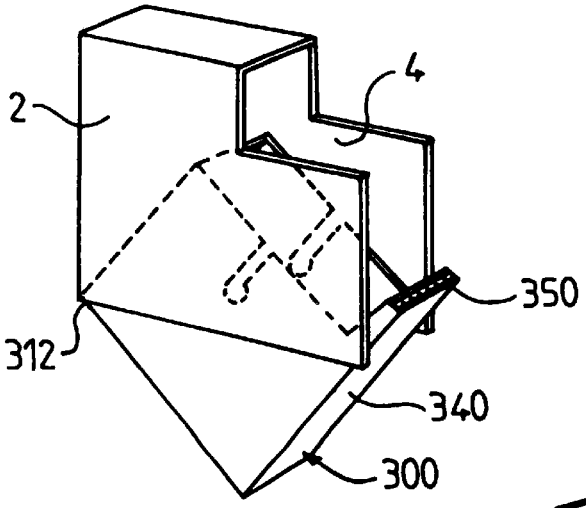
FIG.9C
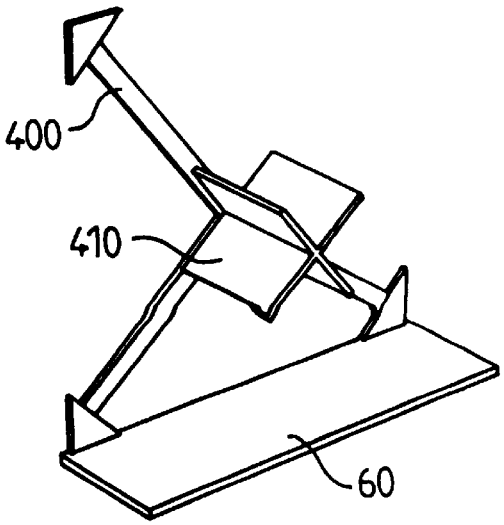
FIG.10

TAPE DISPENSING BOX HOLDING PAPER SHEETS

BACKGROUND OF THE INVENTION

The present invention concerns a dispensing box for tape, in particular for adhesive tape.

Dispensing boxes for adhesive tapes are known which generally comprise a cover attached removably to the box body. To centre the reel of tape in the box, the body of the box bears on its base a tubular axial projection on which the reel of tape rests. In the same way the cover comprises a tubular axial projection complementary to the projection of the boxed body to penetrate into this and into the reel thus held in order to support the reel in the box and allow its rotation.

In practice, an attachment to the box body is associated with a slot for holding and dispensing the adhesive tape outside the box. Usually a serrated extremity of the attachment supports and cuts the tape.

In our modern society of communications it is increasingly important and necessary to identify, mark or personalise products or articles for general distribution with selected wording or information.

At present this type of dispensing box has little or no flat clear space to hold easily inside the box paper sheets or similar means able to bear inscriptions, in particular due to the tubular projections supporting the reel of tape which occupy the base of the box body and lid.

A known solution is to use display panels outside the box. However such a solution requires an operation of gluing the panels which is costly to implement.

OBJECTS OF THE INVENTION

The present invention provides a solution to this problem by making it possible to hold paper sheets inside the box without gluing, by the introduction and support of these sheets in an appropriate manner.

It concerns an dispensing box for tape, in particular for adhesive tape, the box comprising parallel main first and second faces, means of support of the tape reel inside the box during dispensing, an outlet slot for supplying the tape outside the box and means for cutting the tape.

SUMMARY OF THE INVENTION

According to a general definition of the invention, the support means are arranged such that when the reel is in the box, at least the inner surface of one of the first and second main faces is totally clear to hold a first sheet of paper or similar means able to bear the selected information.

The arrangement of the box with a single sheet of paper placed on the main face corresponds to reel support means of one piece with the other main face.

The phrase totally clear here means the absence of projection on the main faces of the box.

According to an important characteristic of the invention, the means of supporting the reel are also arranged such that when the reel is in the box, the inner surface of the other of the first and second main faces is totally clear to hold a second sheet of paper or similar means able to bear selected information.

According to a first design mode of the invention, the support means comprise a removable platform with at least one approximately flat face parallel to the first and second main faces and of which one of the sides is intended to rest on the transparent inner surface of one of the first and second main faces, and of which the other side comprises a reel core support, the said support having a first extremity of one piece with the platform and a second free extremity to position the reel core.

In practice the box also has four side faces to form a box of approximately parallelepipedic form. In this case the platform advantageously also comprises a second flat face perpendicular to the first flat face, the shape and dimensions of which are selected to form one of the side faces of the box.

According to a second design mode of the invention, the support means comprise a removable platform with approximately flat first and second faces parallel to the first and second main faces and separated from each other by a reel core support, each flat face of the platform being intended to rest on the inner surface of the first and second main faces respectively.

The reel core support may be made of one part or replaced by two protrusions on each face of the platform which act as a core support.

In a third design mode of the invention, the support means comprise a removable platform with an approximately flat face parallel to the first and second main faces, one of the sides of the flat face of the platform comprising a first core support for a first tape reel, the said first core support having a first extremity of one piece with the platform and a second free extremity, and the other side of the flat face of the platform comprising a second core support for a second tape reel, the second core support having a first extremity of one piece with the platform and a second free extremity.

In practice the box comprises means of assembly of the first and second main faces with the possibility of opening and closure.

The box is formed either by arrangement of the box body and an attached lid or by a box open on one its four side faces, the face then forming part of the reel support platform, or with an opening and closing flap articulated about a hinge axis.

Preferably at least one of the first and second main faces and the platform are arranged to delimit the outlet slot.

Advantageously the cutting device is housed in one of the side faces of the box close to the outlet slot.

In the two reel variant, the first and second main faces and the platform are arranged advantageously to delimit two outlet slots, one for the first reel and another for the second reel.

In this case too the box also comprises two cutting elements housed respectively in one of the side faces of the box close to their respective outlet slots.

Other characteristics and advantages of the invention will appear in the light of the detailed description below and the attached drawings.

BRIEF DESCRIPTION OF THE DRAWINGS

FIGS. 1A to 1C and 1E, 1F show in exploded view the essential and constituent components of the box according to the invention with a flap articulated around a hinge axis;

FIG. 1D shows in diagram form a tape reel of the known type;

FIG. 1E shows a single sheet 32 similar to the sheet 32 in FIG. 1A;

FIG. 1F shows a combination of components shown separately in FIGS. 1B and 1C.

FIG. 2A shows the box with the two sheets of paper held by the two main faces of the box according to the invention;

FIG. 2B illustrates the positioning of the reel on the core support of the platform according to the invention;

FIG. 3A illustrates the positioning of the platform in the box according to the invention;

FIG. 3B shows the box according to the invention in its closed position;

FIGS. 5A to 5C illustrate a variant of the design mode described with reference to FIGS. 4A to 4C;

FIGS. 8A1 to 8C2 illustrate a variant of the removable platform according to the invention;

FIGS. 9A to 9C illustrate two other variants of the removable platform, one mounted sliding and the other mounted pivoting according to the invention, with two flat parallel surfaces supporting the reel; and FIG. 10 illustrates another variant of the platform according to the invention with a face not flat, fitted with cross pieces.

DETAILED DESCRIPTION OF THE INVENTION

Figure 4A:
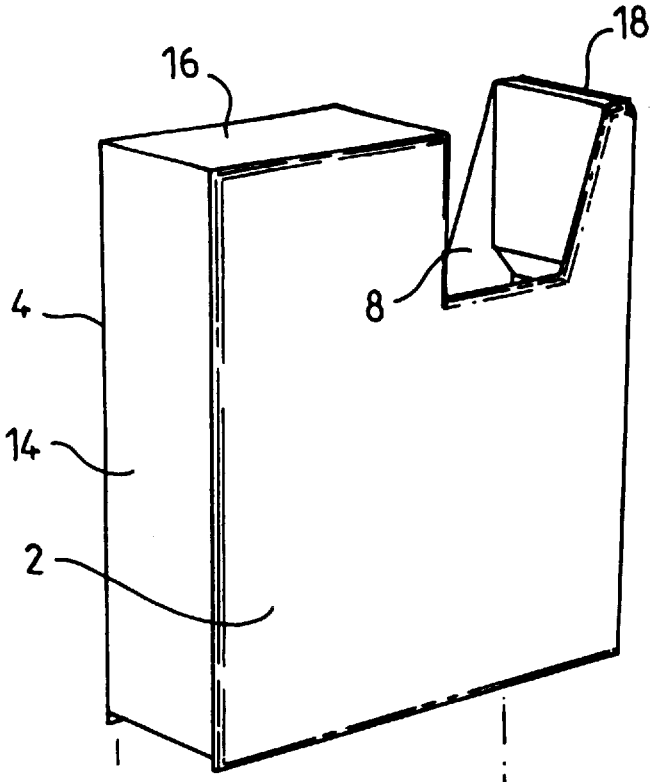
FIGS. 4A to 4C illustrate a design mode of the box according to the invention in which the platform comprises two flat surfaces perpendicular to each other, one of which acts as a side face of the box to ensure the opening and closing of the box.

With reference to FIG. 1D, the present invention concerns the tape dispensing box, in particular for adhesive tape, in which the tape reel BOB is cylindrical in form with a height determined by the width of the tape RUB. The tape reel BOB also comprises a cylindrical core MAN.

With reference to FIG. 1B, here the box is of generally parallelepipedic form with two main parallel faces 2 and 4 and four side faces 10, 12, 14 and 16.

The two main faces 2 and 4 and the side faces 10, 12, 14 and 16 are of generally rectangular flat shape. They may have a more curved form where applicable.

With reference to FIG. 1B, the box is open and with reference to FIG. 3B, the box is closed.

Face 4 is arranged to form a slot 8 for the outlet of the tape from the box. The side faces 10, 12, 14 and 16 complete the box to form an approximately sealed envelope. The widths of the side faces 10, 12, 14 and 16 are selected so that the box can contain a tape reel BOB of selected or standard thickness, for example a few centimeters.

Close to slot 8, the side face 10 is arranged to hold a serrated extremity 18 which serves for support and cutting of the tape. This serrated extremity may be that of a metallic cutting blade 17 housed in a housing provided on the side face 10. The side face 14 serves to the connect the main faces 2 and 4.

For example means of assembly 6 of the parallel faces 2 and 4, of the type articulated around a hinge axis, comprise means forming a pivot allowing the side face 14 adjacent to the face 4 to pivot about the vertical axis 3 and thus ensure the opening and closure of the box.

With reference to FIGS. 1A to 1C, a booklet 30 comprising two sheets 32 and 34 of dimensions approximately similar to those of faces 2 and 4 can be placed inside the box described in FIG. 1B. This booklet 30 is intended to bear markings visible through the transparent faces 2 and 4 in order to mark, personalise or identify the box, its content, its destination or other according to the invention. The booklet 30 also comprises a strip 36 of dimensions appropriate to the side face 14 and intended to link the two sheets 32 and 34.

It should be noted that the shape of the sheet 34 is also arranged as a function of the shape of the slot 8 for the tape outlet.

To allow the introduction of the booklet 30 into the box according to the invention, a removable platform 40 is provided (FIG. 1C) comprising an approximately flat face 42 parallel to the first and second main faces 2 and 4, and of which one of the sides 44 is intended to rest on the inner surface 5 of the main face 4, and of which the other side 46 comprises a core support 48 for the tape reel BOB. The core support 48 has a first extremity 50 of one piece with the platform 40 and a second free extremity 52 for positioning the tape reel core.

The length of core support 48 and its diameter are selected as a function of the width of tape RUB and the diameter of the reel core.

Advantageously the core support is positioned approximately in the centre of platform 40 in order to allow centring of the reel in the box.

With reference to FIG. 2A, the booklet 30 described with reference to FIG. 1A is now introduced into the box described with reference to FIG. 1B with appropriate positioning such that the sheets 32 and 34 and the strip 36 cover the main faces 2 and 4 and side face 14.

As the material constituting faces 2 and 4 and strip 14 is advantageously transparent, the markings on sheets 32, 34 and 36 of booklet 30 are visible from the outside of the box.

In practice the booklet is held in the box by pins (not shown). As a variant these pins may be replaced by sliders (not shown) or even omitted completely.

With reference to FIG. 1E, a single sheet 32 is shown. With reference to FIG. 1F, the box is open similar to FIG. 1B but with the platform 40 inserted on side 5 of face 4 and the sheet 32 attached to face 2.

With reference to FIG. 2B, reel BOB is held on the core support 48 of platform 40.

With reference to FIG. 3A, the platform 40 containing the reel BOB is now inserted in the box in order to rest on the inner surface 5 of the main face 4 of the box.

The platform 40 may be held on side 5 of face 4 by appropriate fixing means (not shown) or simply placed against this and held by blockage and closure of the box.

Finally with reference to FIG. 3B, the box containing the reel according to the arrangement described with reference to FIG. 3A is now shown in the closed position with the tape RUB emerging from slot 8 and resting on the serrated extremity 18 for cutting.

Figure 4B:
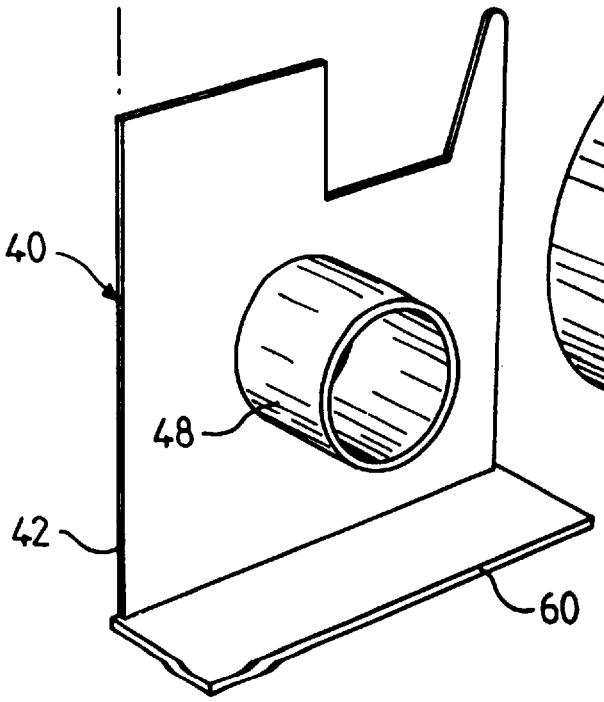
Figure 4C:
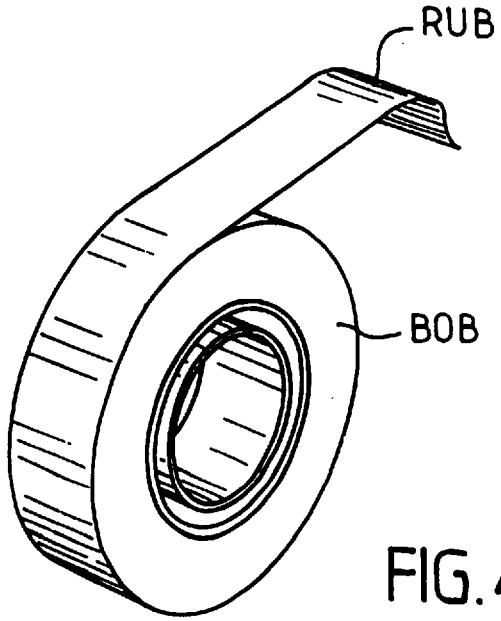

With reference to FIGS. 4A to 4C, a variant of the box according to the invention is shown in which the box no longer has the possibility of opening/closing by the means of pivoting or articulated assembly but in which the removable platform is able to slide inside the box, the sliding of the platform ensuring the opening or closure of the said box.

In practice platform 40, with reference to FIG. 4B, comprises the same elements as those described with reference to FIG. 1C except that it also comprises a second flat face 60 perpendicular to the flat face 42. This flat face 60 constitutes a side face of the box. This face 60 corresponds to the side face 12 described with reference to FIG. 1B.

For the rest, the box according to the invention comprises the same elements as those described with reference to FIG.

1B, namely a slot 8 for outlet of the tape from the box and a serrated extremity 18 for support and cutting of the tape.

It should be noted that the booklet bearing the selected marking is introduced in a manner similar to that described with reference to FIG. 2A.

Also the reel of tape BOB described with reference to FIG. 4C is the same as that described in FIG. 1D. It is intended to be placed on the core support 48 in accordance with FIG. 2B.

In the closed position, the removable platform 40 is held locked in the box by appropriate fixing means such as pins, clips or sliders (not shown).

The platform is released to allow its extraction from the box by pulling the platform towards the outside in order to release the fixing means from their supports on the side faces of the box.

With reference to FIGS. 5A to 5C, another variant of the removable platform is shown which supports the reel in the box.

With reference to FIG. 5A, the platform 40 comprises a first flat face 42 in accordance with that described with reference to FIG. 1C and a second flat face 70 perpendicular to face 42. The platform 40 is intended to be introduced into the box in accordance with the arrows shown in FIG. 5A. The flat face 70 is able to close the box when the platform 40 is fully introduced into the box.

The flat face 70 here constitutes the side face 14 of the box described with reference to FIG. 1B.

In this variant the booklet can advantageously be separated into two sheets and divided over each main face.

Figure 6A:
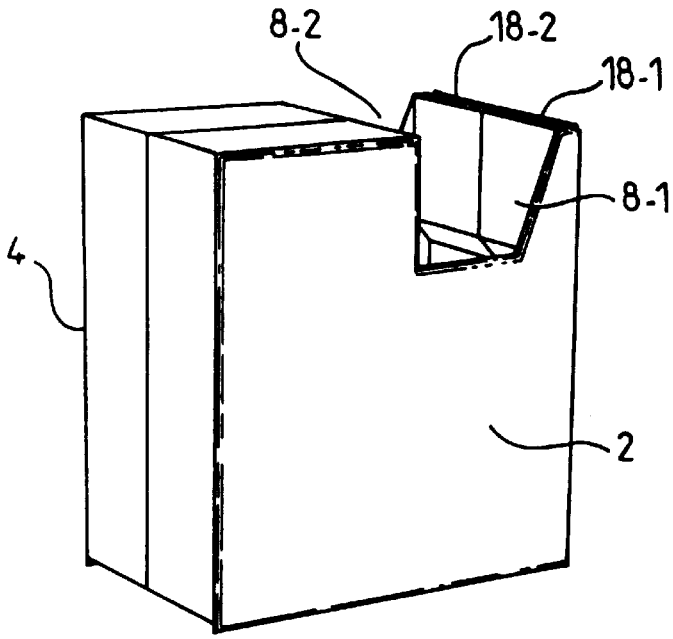
FIGS. 6A to 6C illustrate a design mode of a box according to the invention containing two tape reels.
Figure 6B:
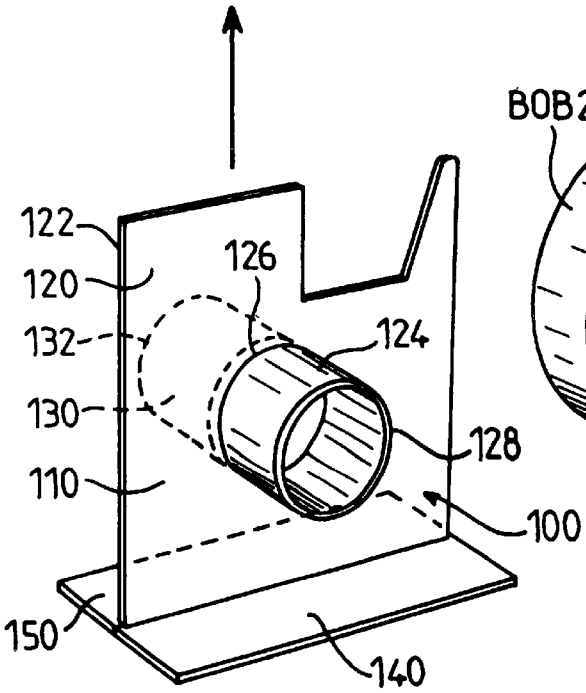
Figure 6C:
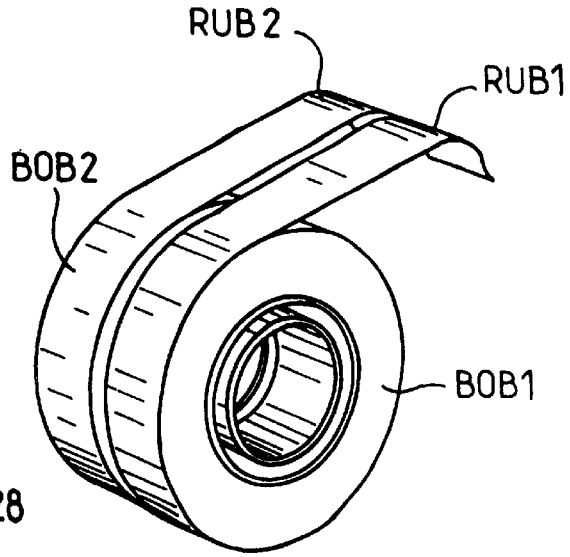

With reference to FIGS. 6A to 6C, another design mode of the box according to the invention is shown in which the box contains two tape reels BOB1 and BOB2.

With reference to FIG. 6B, the means for supporting the reels BOB1 and BOB2 comprise a removable platform 100 with an approximately flat surface 110 parallel to the first and second main faces 2 and 4 of the box. One of the sides 120 of the flat face 110 comprises a first core support 124 for the first reel BOB1. The first core support 124 has a first extremity 126 of one piece with the platform 110 and a second free extremity 128.

The other side 122 of the flat face 110 comprises a second core support 130 for the second reel BOB2. The second core support has a first extremity (not shown) of one piece with the platform and a second free extremity 132.

The platform 100 also comprises a first flat face 140 perpendicular to the flat surface 110. This flat face 140 in fact constitutes half the base of the box.

A second flat face 150 is provided. This is arranged on the other side of the flat face 110 perpendicular to the same flat face 110 to constitute the other half of the base of the box.

In accordance with FIG. 6B, the removable platform 100 is intended to be introduced into the box in order to place the reels BOB1 and BOB2 inside the said box, the surfaces 140 and 150 ensuring the box closure.

The booklets bearing the marking are introduced and held in the box against the two main faces of the box as previously described.

With reference to FIG. 6C, reels BOB1 and BOB2 are adjacent with their tape ends oriented in the same direction. With reference to FIG. 6A, outlet slots 8-1 and 8-2 of tapes RUB1 and RUB2 are also adjacent and separated by the platform.

Figures 7A, 7B, 7C, 7D:
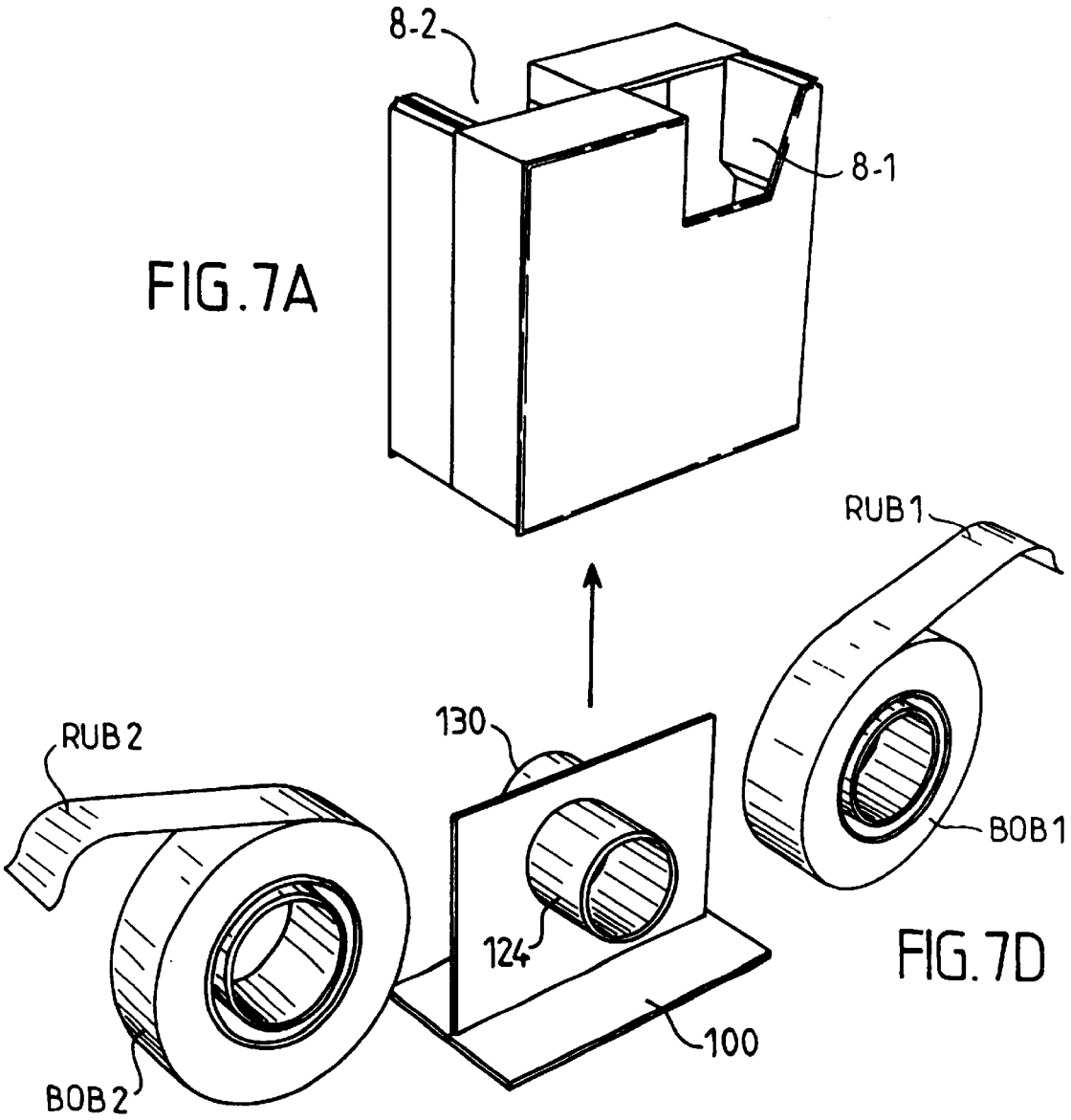
FIGS. 7A to 7D illustrate a variant of the design mode with two reels according to the invention.

With reference to FIG. 7A, a variant of the two reel box is shown in which the outlet slots 8-1 and 8-2 are opposite each other.

For the rest, the platform described in reference to FIG. 7C is identical to that described in reference to FIG. 6B.

With reference to FIGS. 8A1 and 8C2, the removable platform 200 comprises a flat face 210 perpendicular to the two main faces 2 and 4 of the box.

The platform 200 supports a reel BOB with a core support 212 held by forks 214 (parallel to faces 2 and 4 and able to assume different shapes) or by separation of the two faces parallel to faces 2 and 4 and provision of the elasticity necessary to support the reel core.

With reference to FIGS. 9A and 9B, another design mode of the box according to the invention is shown in which the removable platform 300 comprises first and second approximately flat surfaces 310 and 320 parallel to the main first and second faces 2 and 4 of the box. The flat faces 310 and 320 are separated from each other by a core support 330 for tape reel BOB.

Each flat face 310 and 320 is intended to lie against the inner surface of the first and second main faces 2 and 4 respectively. The platform 300 is here intended to be introduced into the box by sliding.

With reference to FIG. 9C, the removable platform 300 described with reference to FIG. 9B is now mounted to pivot about an axis 312 perpendicular to the main faces 2 and 4 instead of being mounted sliding as in reference to FIGS. 9A and 9B.

With reference to FIGS. 9A to 9C, platform 300 also comprises a side strip 340, the end 350 of which constitutes the serrated extremity for the support and cutting of the tape.

With reference to FIGS. 9A to 9C, the box may be fully sealed by omitting the outlet slot and/or the cutting element. The tape is then grasped and withdrawn by first withdrawing platform 300 from the box as far as a stop notch (not shown) made on one of the faces of the box.

Naturally other design modes may be considered for implementation of the box according to the invention. For example the platform may be produced with a surface not flat, constituted by cross pieces 400 (FIG. 10) bearing the holding support 410.

What is claimed is:

1. A dispensing box for dispensing tape from an unwrapped reel of tape having a substantially parallelepipedic form and including a first main wall having an inner face and a second main wall having an inner face and connected to said first main wall by at least one side wall, the inner face of at least one of said first and second main walls having an unbroken and unobstructed central portion, a support for the tape reel, an output slot for the tape, and cutting means for cutting the tape, the second main wall being movable with respect to said at least one side wall, and a sheet of indicia-bearing material held between the inner surface of said at least one unbroken and unobstructed main wall and the reel of tape, whereby the information on said indicia-bearing sheet of material is visible through said at least one unbroken and unobstructed main wall.

2. The dispensing box of claim 1 wherein said second main wall is pivotably connected to said at least one side wall.

3. The dispensing box of claim 1 wherein the inner face of said first main wall and the inner face of said second main wall each have an unbroken and unobstructed central portion.

4. The dispensing box of claim 1 wherein said support for the tape reel includes a first core support for supporting the reel of tape and a second core support for supporting a second reel of tape.

5. A dispensing box for dispensing tape from an unwrapped reel of tape having a substantially parallelepipedic form and including a first main wall having an inner face and a second main wall having an inner face and connected to said first main wall by at least one side wall, the inner face of at least one of said first and second main walls having an unbroken and unobstructed central portion, a removable tape support for the tape reel, an output slot for the tape, and cutting means for cutting the tape, wherein at least one of said first and second main walls or at least one of said at Least one side wall is movable to allow said removable tape support to be removed from said box.

6. The dispensing box of claim 5 further including a sheet of indicia-bearing material mounted between said tape support and said at least one of said first and second main walls.

7. The dispensing box of claim 5 wherein the inner face of said first main wall and the inner face of said second main wall each have an unbroken and unobstructed central portion.

8. The dispensing box of claim 5 wherein said removable tape support comprises a first core support for supporting the reel of tape and a second core support for supporting a second reel of tape.

9. The dispensing box of claim 8 wherein said removable tape support includes a first wall for supporting the tape reel and a second wall normal to said first wall, said at least one side wall comprising three side walls and said removable tape support second wall.

10. A dispensing box for dispensing tape from an unwrapped reel of tape having a substantially parallelepipedic form and including a first main wall having an inner face and a second main wall having an inner face and connected by at least one side wall, the inner face of at least one of said first and second main walls having an unbroken and unobstructed central portion, a support for the tape reel removably mounted between said first main wall and second main wall, an output slot for the tape, and cutting means for cutting the tape, and a sheet of indicia-bearing material held between the inner surface of said at least one unbroken and unobstructed main wall and the reel of tape, whereby the information on said indicia-bearing sheet of material is visible through said at least one unbroken and unobstructed main wall.

11. A dispensing box according to claim 10 wherein said at least one side wall comprises three side walls and wherein said support includes a base portion forming one of said three side walls when said support is mounted between said first and second main walls.

12. The dispensing box of claim 10 wherein the inner face of said first main wall and the inner face of said second main wall each have an unbroken and unobstructed central portion.

13. The dispensing box of claim 10 wherein said tape support comprises a first core support for supporting the reel of tape and a second core support for supporting a second reel of tape.

14. The dispensing box of claim 10 wherein said at least one side wall comprises four side walls and one of said four side walls comprises a portion of said support for said tape reel.

15. The dispensing box of claim 9 wherein said removable tape support is slidable in the plane of the first and second main walls between a first position wherein said removable tape support second wall contacts said at least one sidewall to close said box and a second position wherein said removable tape support second wall is spaced apart from said at least one side wall to open said box.

16. The dispensing box of claim 11 wherein said removable tape support is slidable in the plane of the first and second main walls between a first position wherein said removable tape support base portion contacts said at least one sidewall to close said box and a second position wherein said removable tape support base is spaced apart from said at least one side wall to open said box.

* * * * *